US008140343B2

(12) United States Patent
Hu et al.

(10) Patent No.: US 8,140,343 B2
(45) Date of Patent: *Mar. 20, 2012

(54) METHOD, DEVICE AND SYSTEM FOR SIGNAL ENCODING AND DECODING

(75) Inventors: Chen Hu, Shenzhen (CN); Zexin Liu, Shenzhen (CN); Lei Miao, Shenzhen (CN); Longyin Chen, Shenzhen (CN); Qing Zhang, Shenzhen (CN); Wei Xiao, Shenzhen (CN); Herve Marcel Taddei, Voorburg (NL)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 13/210,127

(22) Filed: Aug. 15, 2011

(65) Prior Publication Data

US 2011/0286549 A1 Nov. 24, 2011

Related U.S. Application Data

(63) Continuation of application No. 13/111,834, filed on May 19, 2011, which is a continuation of application No. PCT/CN2009/076218, filed on Dec. 29, 2009.

(30) Foreign Application Priority Data

Dec. 30, 2008 (CN) ..... 2008 1 0247589

(51) Int. Cl.
*G10L 19/00* (2006.01)
*G10L 21/04* (2006.01)

(52) U.S. Cl. ..... 704/500; 704/501; 704/502; 704/503; 704/504

(58) Field of Classification Search ..... 704/500–504
See application file for complete search history.

(56) References Cited

U.S. PATENT DOCUMENTS

| | | | | |
|---|---|---|---|---|
| 6,349,284 | B1 * | 2/2002 | Park et al. | 704/500 |
| 7,516,230 | B2 * | 4/2009 | Sperschneider et al. | 709/231 |
| 8,010,349 | B2 * | 8/2011 | Oshikiri | 704/206 |
| 2002/0049583 | A1 | 4/2002 | Bruhn et al. | |
| 2007/0274383 | A1 | 11/2007 | Yu et al. | |
| 2008/0120096 | A1 | 5/2008 | Oh et al. | |
| 2009/0094023 | A1 | 4/2009 | Sung et al. | |
| 2009/0138272 | A1 | 5/2009 | Kim et al. | |
| 2009/0259477 | A1 | 10/2009 | Ashley et al. | |
| 2010/0169099 | A1 | 7/2010 | Ashley et al. | |

* cited by examiner

*Primary Examiner* — Paras Shah
(74) *Attorney, Agent, or Firm* — Conley Rose, P.C.; Grant Rodolph

(57) ABSTRACT

A method, device and system for signal encoding and decoding, the method comprising: encoding a core layer signal to obtain a core layer signal code; selecting an enhancement sample point that requires enhancement layer signal encoding according to the core layer signal code and the number of bits that can be used by an enhancement layer; obtaining an enhancement layer signal code of the enhancement sample point; and outputting a bit stream, where the bit stream includes the core layer signal code and the enhancement layer signal code. In embodiments of the present invention, according to the number of bits that can be used by the enhancement layer, the enhancement sample point that requires enhancement layer signal encoding is selected; the enhancement layer signal of the selected enhancement sample point is encoded and decoded; when no sufficient bits are available for the enhancement layer, the enhancement quality of the core layer can be improved.

10 Claims, 10 Drawing Sheets

METHOD, DEVICE AND SYSTEM FOR SIGNAL ENCODING AND DECODING

CROSS-REFERENCE TO RELATED APPLICATIONS

This application is a continuation of U.S. patent application Ser. No. 13/111,834, filed on May 19, 2011, which is a continuation of International Application No. PCT/CN2009/076218, filed on Dec. 29, 2009. The International Application claims priority to Chinese Patent Application No. 200810247589.X, filed on Dec. 30, 2008. The afore-mentioned patent applications are hereby incorporated by reference in their entireties.

FIELD OF THE INVENTION

The present invention relates to the speech/audio encoding and decoding field, and in particular, to a method, device and system for signal encoding and decoding.

BACKGROUND OF THE INVENTION

In the 1980s, all traditional speech encoding and decoding methods are based on the pulse code modulation (PCM) technology. For example, G.711 is a speech encoding and decoding technology completely based on PCM; G.722 is a speech encoding and decoding technology based on adaptive differential pulse code modulation (ADPCM), where ADPCM is improved PCM. The PCM technology is usually applied to narrowband signals or wideband signals. Because the speech of people is also centered on narrowband or wideband, the technology has a good speech encoding and decoding effect.

With the development of network technologies and increase of the network bandwidth and transmission rate, people impose higher requirements on quality of the speech/audio in communication. More and more communication standardization organizations are researching technologies for encoding, decoding and transmitting wideband, ultra-wideband, and even full-band and stereo speech/audio signals. To get compatible with the traditional speech encoding and decoding methods, most bandwidth extension standards, such as the wideband extension standard G.711.1 of G.711 of the International Telecommunication Union (ITU) and the combined ultra-wideband stereo extension project G.711.1/G.722, extend the bandwidth based on the original narrowband or wideband single-channel codec. The traditional narrowband or wideband encoding and decoding methods are referred to as the core layer of an extended codec that corresponds to the traditional narrowband or wideband encoding and decoding methods.

The above extension method is compatible with the traditional encoding and decoding methods, but also brings about some problems. Because the core layer usually uses a simple PCM encoding and decoding method, the encoding and decoding quality is poor; to ensure the quality of an entire wideband signal, the corresponding extension method must further enhance the encoding and decoding quality of the core layer. In the prior art, the method for enhancing the encoding and decoding quality of the core layer is categorized into the following two types:

One is: No extra bit is added, and the core layer enhancement performed by using the pre-processing (such as noise shaping processing) or post-processing technology. The merit of this method is that no extra bit is used, but the application scope is limited to some extent; for most traditional codes, using this method cannot get a good enhancement effect.

The other is: Without changing the traditional core layer encoding and decoding method, sufficient scalar or vector quantized bits are added to improve the precision of core layer encoding, thus enhancing the core layer quality. The demerit of this method is that a large number of extra bits are required. If the core layer is a PCM-based scalar quantizer, each sample point is enhanced by consuming 2 bits, which increases the burden of the extended codec greatly; no sufficient bits are available in many cases, and therefore the enhancement quality of the core layer is not ensured.

SUMMARY OF THE INVENTION

Embodiments of the present invention provide a method, device and system for signal encoding and decoding, which can improve the enhancement quality of the core layer when no sufficient bits are available for the enhancement layer.

An embodiment of the present invention provides a signal encoding method, including: encoding a core layer signal to obtain a core layer signal code; selecting, according to the core layer signal code and the number of bits that can be used by an enhancement layer, an enhancement sample point that requires enhancement layer signal encoding; obtaining an enhancement layer signal code of the enhancement sample point; and outputting a bit stream, where the bit stream includes the core layer signal code and the enhancement layer signal code.

An embodiment of the present invention provides a signal decoding method, including: receiving a bit stream, where the bit stream includes a core layer signal code and an enhancement layer signal code; selecting, according to the received bit stream and the number of bits that can be used by an enhancement layer, an enhancement sample point that requires enhancement layer signal decoding; decoding the enhancement layer signal code of the enhancement sample point to obtain an enhancement layer signal; and obtaining a modified core layer signal according to the enhancement layer signal and the bit stream.

An embodiment of the present invention provides a signal encoding device, including: a core layer encoding module, configured to encode a core layer signal to obtain a core layer signal code; at least one enhancement sample point selecting module, configured to select, according to the core layer signal code and the number of bits that can be used by an enhancement layer, an enhancement sample point that requires enhancement layer signal encoding; at least one enhancement layer encoding module, configured to obtain an enhancement layer signal code of the enhancement sample point; and an outputting module, configured to output a bit stream, where the bit stream includes the core layer signal code and the enhancement layer signal code.

An embodiment of the present invention provides a signal decoding device, including: a receiving module, configured to receive a bit stream, where the bit stream includes a core layer signal code and an enhancement layer signal code; at least one enhancement sample point selecting module, configured to select, according to the received bit stream and the number of bits that can be used by an enhancement layer, an enhancement sample point that requires enhancement layer signal decoding; at least one enhancement layer decoding module, configured to decode the enhancement layer signal code of the enhancement sample point to obtain an enhancement layer signal; and a modifying module, configured to obtain, according to the enhancement layer signal and the bit stream, a modified core layer signal.

An embodiment of the present invention provides a signal encoding and decoding system, including: a signal encoding device, configured to: encode a core layer signal to obtain a core layer signal code; select, according to the core layer signal code and the number of bits that can be used by an enhancement layer, an enhancement sample point that requires enhancement layer signal encoding; obtain an enhancement layer signal code of the enhancement sample point; and output a bit stream, where the hit stream includes the core layer signal code and the enhancement layer signal code; and a signal decoding device, configured to: receive the bit stream, where the bit stream includes the core layer signal code and the enhancement layer signal code; select, according to the received bit stream and the number of bits that can be used by the enhancement layer, an enhancement sample point that requires enhancement layer signal decoding; decode the enhancement layer signal code of the enhancement sample point to obtain, according to the enhancement layer signal and the bit stream, an enhancement layer signal; and obtain a modified core layer signal.

In embodiments of the present invention, according to the number of bits that can be used by the enhancement layer, the enhancement sample point that requires enhancement layer signal encoding is selected; the enhancement layer signal of the selected enhancement sample point is encoded and decoded; when no sufficient bits are available for the enhancement layer, the enhancement quality of the core layer can be improved.

DETAILED DESCRIPTION OF THE EMBODIMENTS

The technical solution of the present invention is expounded below with reference to accompanying drawings and some exemplary embodiments.

Figure 1:
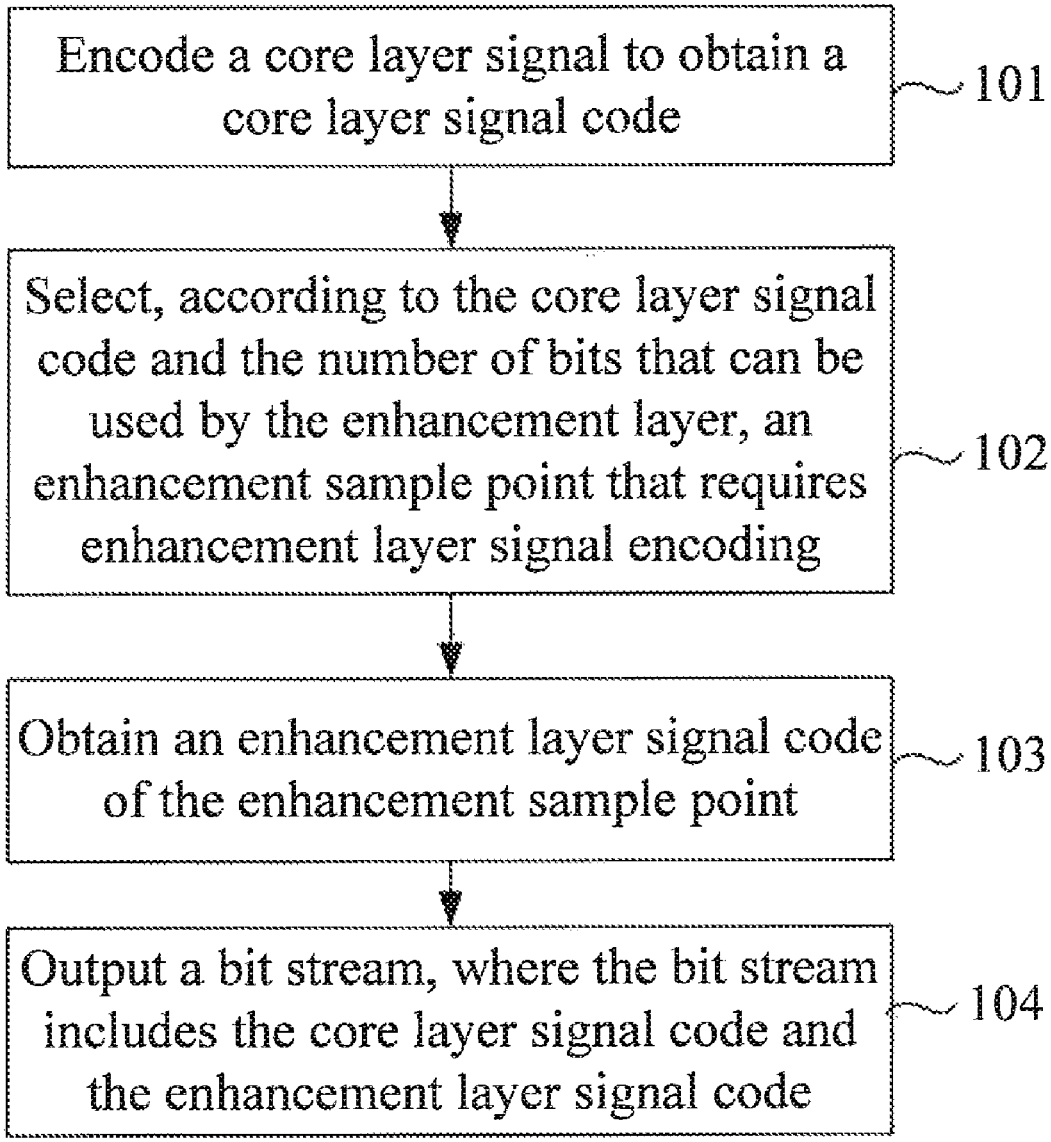
FIG. 1 is a flowchart of a signal encoding method according to a first embodiment of the present invention.

FIG. 1 is a flowchart of a signal encoding method according to the first embodiment of the present invention. The method includes the following steps:

Step 101: Encode a core signal to obtain a core layer signal code.

Step 102: Select, according to the core layer signal code and the number of bits that can be used by the enhancement layer, an enhancement sample point that requires enhancement layer signal encoding.

Step 103: Obtain an enhancement layer signal code of the enhancement sample point.

Step 104: Output a bit stream, where the bit stream includes the core layer signal code and the enhancement layer signal code.

In this embodiment, according to the number of bits that can be used by the enhancement layer, the enhancement sample point that requires enhancement layer signal encoding is selected; the enhancement layer signal of the selected enhancement sample point is encoded; when no sufficient bits are available for the enhancement layer, the enhancement quality of the core layer can be improved.

Figure 2:
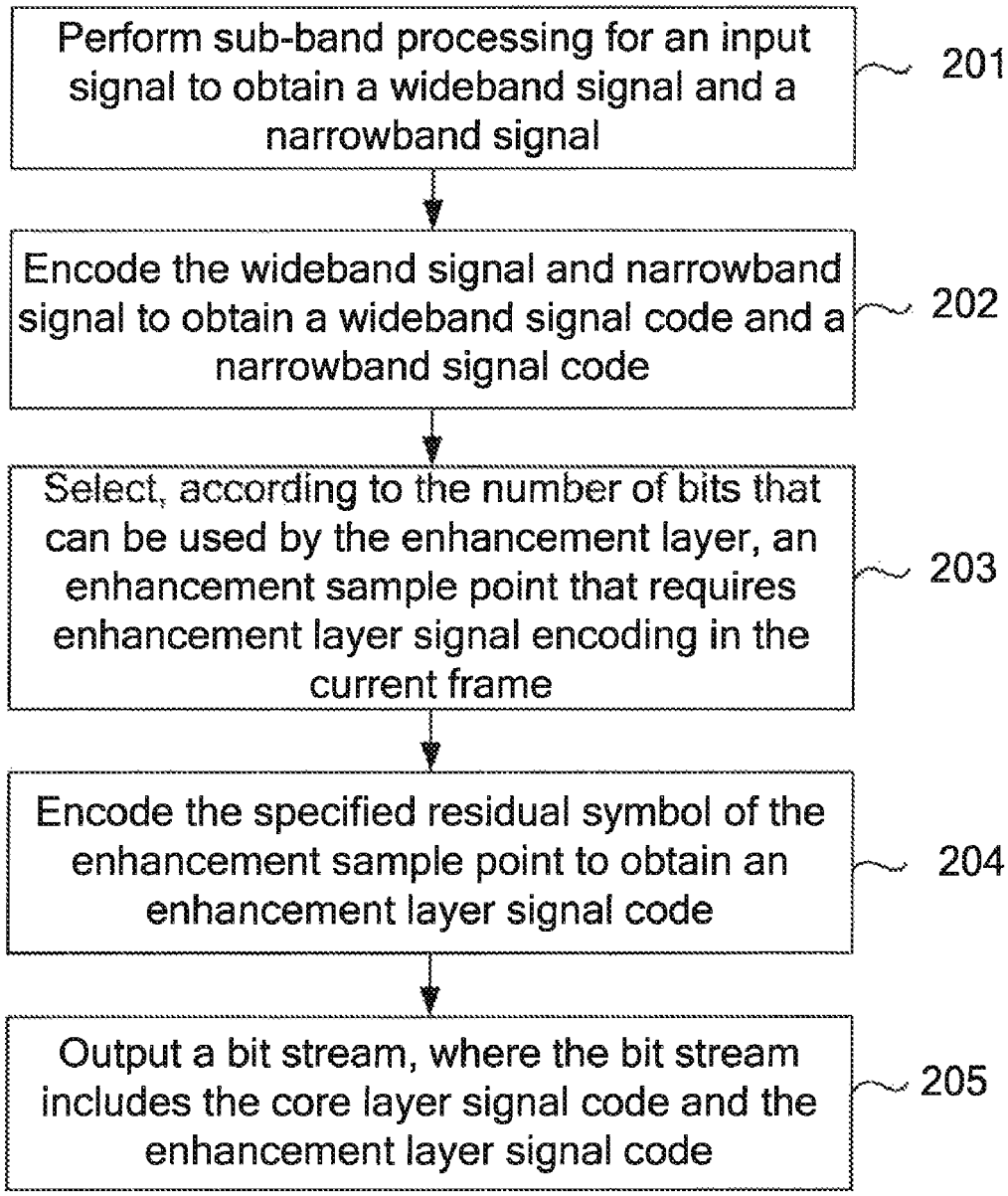
FIG. 2 is a flowchart of a signal encoding method according to a second embodiment of the present invention.

FIG. 2 is a flowchart of a signal encoding method according to the second embodiment of the present invention. This embodiment may be applied in an extended encoding device that is based on PCM encoding, that is, the core layer signal encoding method may be a PCM encoding method; the core layer may use a G.722 encoder which is based on ADPCM encoding, that is, the core layer signal encoding method may be an ADPCM encoding method. This embodiment may also be applied in other extended encoding devices that are based on PCM or technologies evolved from PCM, for example, an extended encoding device that uses G.711/G.711.1 as the core layer or uses G.722/G.711/G.711.1 with noise shaping or post-processing as the core layer, that is, the core layer signal encoding method may be a PCM/ADPCM encoding method in which the noise shaping technology is used. In addition, this embodiment may be applied in other types of extensions, for example, the wideband extension that uses the narrowband signal encoding as the core layer, the full-band extension, or the stereo extension.

This embodiment is applied in an extended encoding device that uses G.722 as the core layer, where the core layer signal includes a wideband signal and/or a narrowband signal. The core layer may select an enhancement sample point as per the sample points of a frame, or divide the sample points of each frame into sample points of several sub-frames and select an enhancement sample point as per the sample points of a sub-frame. This embodiment takes a current frame as an example.

The method according to the second embodiment includes the following steps:

Step 201: Perform sub-band processing for an input signal to obtain a wideband signal and a narrowband signal.

The wideband signal falls within the frequency range of 4000 Hertz (Hz) to 8000 Hz, and the narrowband signal falls within the frequency range of 50 Hz to 4000 Hz. For ease of description, herein N indicates the total number of sample points of a current frame of a core layer wideband signal, and S(n) indicates the $n^{th}$ sample point, where $1 \leqq n \leqq N$.

Step 202: Encode the wideband signal and narrowband signal respectively to obtain a wideband signal code and a narrowband signal code, namely, core layer signal codes.

For the wideband signal, in G.722, the ADPCM encoding method is used to perform predictive coding for each input sample point S(n) in turn and obtain a predicted value SH(n); the original residual signal EH(n) is calculated, where EH(n)= S(n)−SH(n); then PCM encoding is performed for EH(n) to obtain a wideband signal index IH(n), and in particular, a wideband signal quantized table is used and a quantized value closest to EH(n) is found in the wideband signal quantized table, and the index corresponding to this quantized value is the wideband signal index IH(n) of the sample point; local decoding for EH(n) is performed to obtain a locally decoded residual signal DH(n); the predicted value and the locally decoded residual signal are added together to obtain a locally decoded wideband signal Sd(n), where Sd(n)=SH(n)+DH(n). A wideband signal code is obtained through this encoding method. The wideband signal code includes a wideband signal index IH(n) and a predicted value SH(n) of the wideband signal.

The method for encoding a narrowband signal is similar to the method for encoding a wideband signal, and therefore is not described here.

When core layer encoding is performed for the wideband signal and narrowband signal at the same time, the enhancement layer signal may be encoded. The process of selecting an enhancement sample point and encoding an enhancement layer signal is described in steps 203 and 204. This process may be executed after step 202 or during step 202.

Step 203: Select, according to the number of bits that can be used by the enhancement layer, an enhancement sample point that requires enhancement layer signal encoding in the current frame.

Herein, B indicates the number of bits that can be used by the enhancement layer; a indicates an enhancement factor; N indicates the total number of sample points of the current frame; n indicates the sequence number of a sample point, where $0 \leqq n \leqq N-1$; and EN indicates the number of enhancement sample points of the current frame. In this embodiment, $\alpha$ may be 1.

EN may be determined according to the relation between N and the product of B and $\alpha$. In this embodiment, a value may be directly assigned to EN according to the relation between N and the product of B and $\alpha$, and then EN enhancement sample points are selected. For example, if B=19, $\alpha$=1, and N=40, 19 enhancement sample points may be directly selected (EN=19). Enhancement sample points may also be selected according to the following embodiment.

Figure 3A:
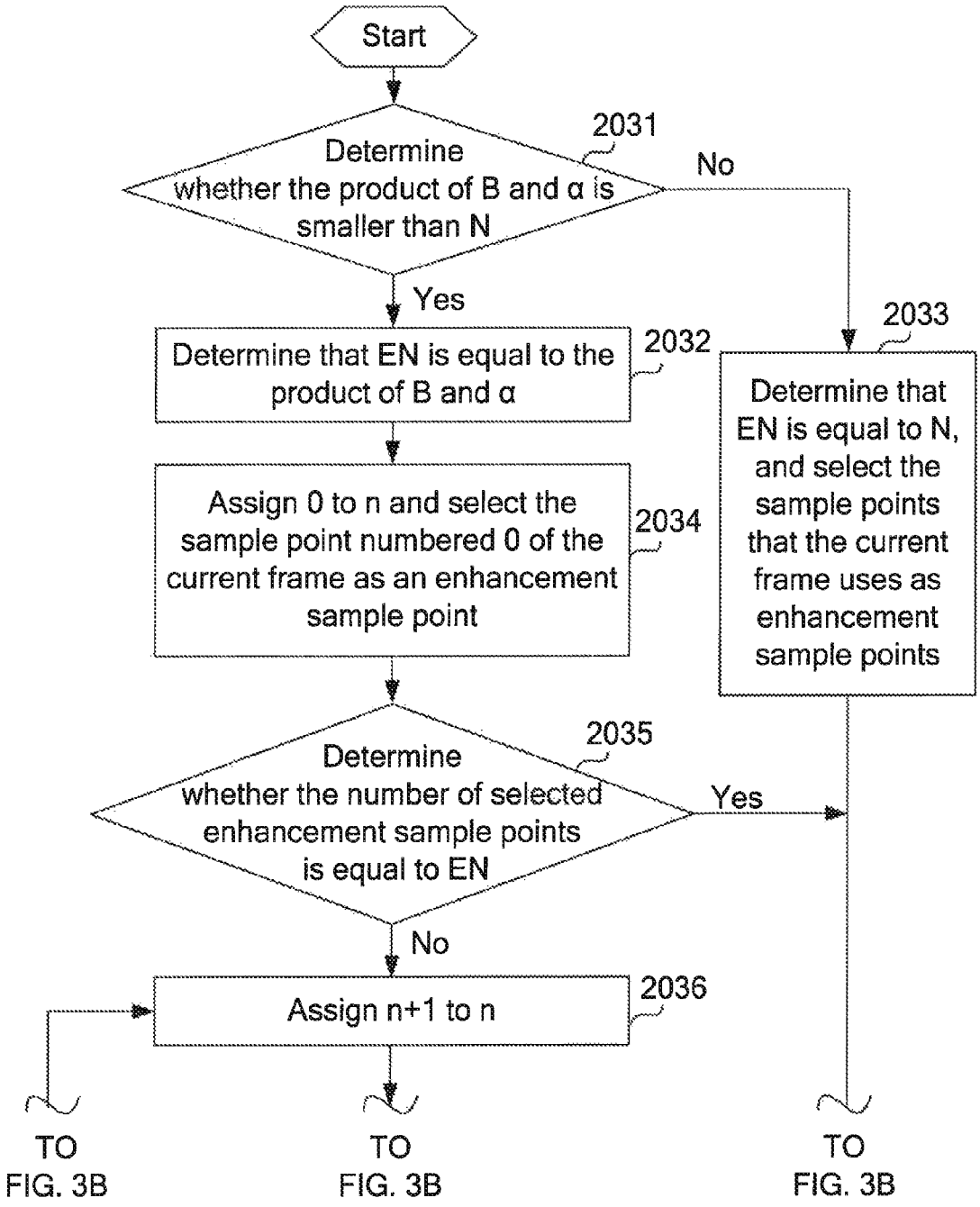
FIG. 3A and FIG. 3B are a flowchart of step 203 in a signal encoding method according to the second embodiment of the present invention.
Figure 3B:
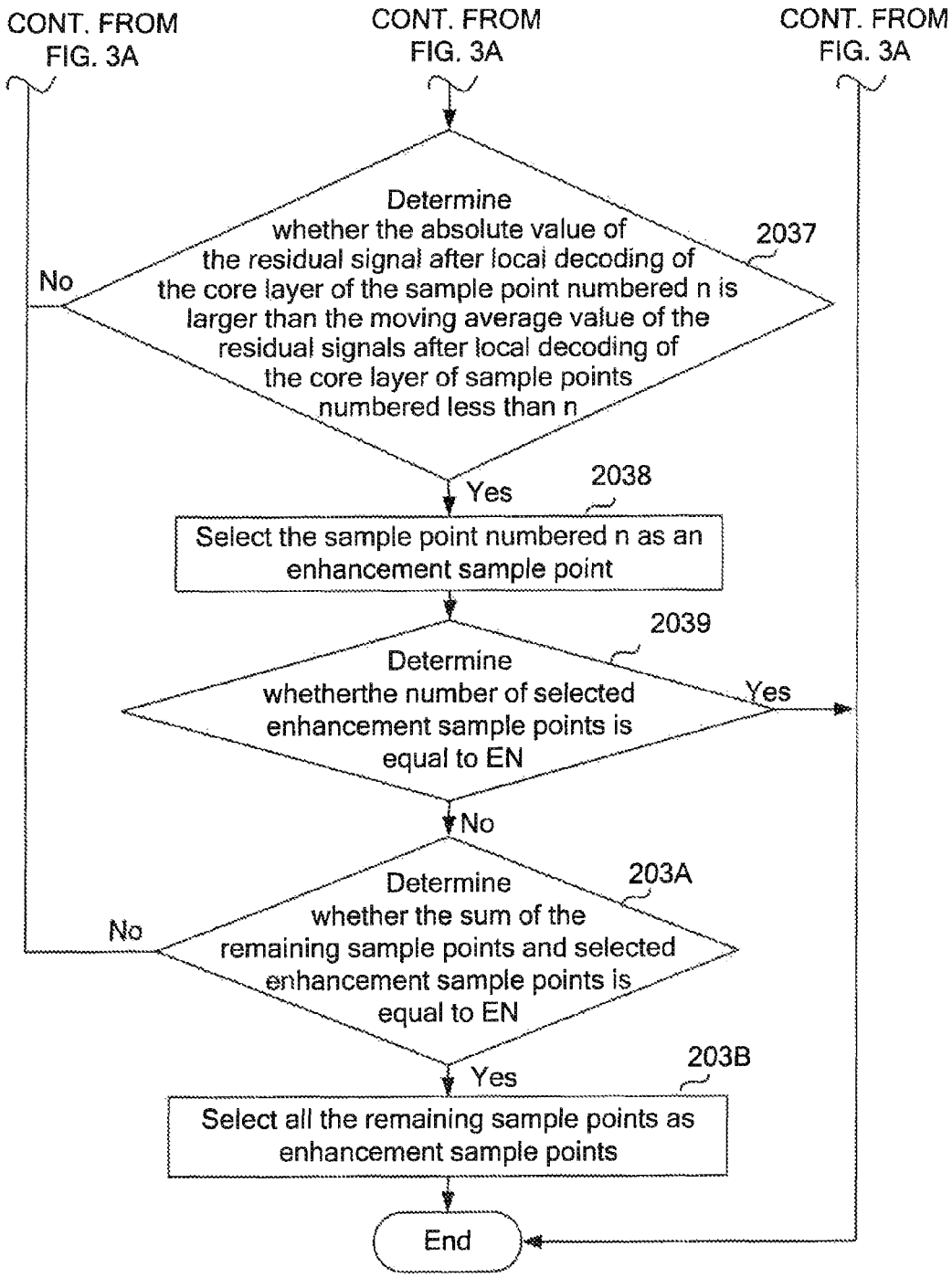

FIGS. 3A and 3B are a flowchart of step 203 in a signal encoding method according to the second embodiment of the present invention. Step 203 includes the following steps:

Step 2031: Determine whether the product of B and $\alpha$ is smaller than N; if the product of B and $\alpha$ is smaller than N, the process proceeds to step 2032; if the product of B and $\alpha$ is larger than or equal to N, the process proceeds to step 2033.

Step 2032: Determine that EN is equal to the product of B and $\alpha$, namely, EN=B, and the process proceeds to step 2034. In this embodiment, $\alpha$ is 1, and the product of B and $\alpha$ is smaller than N, indicating that no sufficient bits are available for the enhancement layer. Therefore, the specific enhancement sample points required by the current frame of the enhancement layer need to be determined according to EN and the nature of the core layer.

Step 2033: Determine that EN is equal to N, select all the sample points of the current frame as enhancement sample points, and the process ends. In this embodiment, $\alpha$ is 1, and the product of B and $\alpha$ is larger than or equal to N, indicating that sufficient bits are available for the enhancement layer. Therefore, all the sample points of the current frame are selected as enhancement sample points.

After step 2032 is executed, an enhancement sample point may be determined according to the size of a specified signal. If the size of the specified signal meets certain conditions, this sample point is selected as an enhancement sample point. Because the core layer encoding is time domain encoding, the specified signal may be the time domain locally decoded PCM value of the core layer. Specifically, the specified signal may be the residual signal after the local decoding of the core layer, or the signal after the local decoding of the core layer (for example, the wideband signal after the local decoding of the core layer), or the signal after the local decoding of the core layer and noise shaping, or the residual signal after the local decoding of the core layer and noise shaping.

Specifically, the process of selecting an enhancement sample point includes: obtaining the moving average value of the specified signal of the sample point numbered n, where the moving average value is the average value of the absolute values of the specified signals of sample points numbered less than n; and according to the moving average value, determining whether the sample point numbered n is an enhancement sample point that requires enhancement layer signal encoding.

Further, the process of determining whether the sample point numbered n is an enhancement sample point that requires enhancement layer signal encoding includes: if n=0, selecting the sample point numbered 0 as an enhancement sample point that requires enhancement layer signal encoding; if $n \neq 0$, determining whether the sum of the remaining sample points and selected enhancement sample points is equal to EN; if the sum is equal to EN, selecting the remaining sample points as enhancement sample points that require enhancement layer signal encoding and ending the process; if the sum is not equal to EN, determining whether the absolute value of the specified signal of the sample point numbered n is larger than the moving average value, and if the absolute value of the specified signal of the sample point numbered n is larger than the moving average value, selecting the sample point numbered n as an enhancement sample point that requires enhancement layer signal encoding and continuing the process until the number of enhancement sample points is equal to EN; if the absolute value of the specified signal of the sample point numbered n is equal to or smaller than the moving average value, not selecting the sample point numbered n as an enhancement sample point that requires enhancement layer signal encoding.

The foregoing process in a preferred embodiment is as follows; Steps 2034 to 2035 are executed after step 2032. In steps 2034 to 2035, the specified signal is a residual signal after the local decoding of the core layer.

Step 2034: Assign 0 to n and select the sample point numbered 0 of the current frame as an enhancement sample point, that is select the first sample point of the current frame as an enhancement sample point. Because no moving average value is available yet, assume that the first sample point of each frame always meets the conditions.

Step 2035: Determine whether the number of selected enhancement sample points is equal to EN; if the number of selected enhancement sample points is equal to EN, the process ends; if the number of selected enhancement sample points is not equal to EN, the process proceeds to step 2036.

After the first sample point is selected as an enhancement sample point, step 2035 determines whether the number of selected enhancement sample points is equal to EN; That is, step 2035 determines whether EN is equal to 1. If EN is equal to 1, the first sample point is selected as an enhancement sample point and step 203 ends.

Step 2036: Assign n+1 to n.

Step 2037: Determine whether the absolute value of the residual signal after the local decoding of the core layer of the sample point numbered n is larger than the moving average value of the residual signals after the local decoding of the core layer of sample points numbered less than n; if the absolute value of the residual signal after the local decoding of the core layer of the sample point numbered n is larger than the moving average value of the residual signals after the local decoding of the core layer of sample points numbered less than n, the process proceeds to step 2038; if the absolute value of the residual signal after the local decoding of the core layer of the sample point numbered n is equal to or smaller than the moving average value of the residual signals after the local decoding of the core layer of sample points numbered less than n, the process proceeds to step 2039.

The absolute value of the residual signal after the local decoding of the core layer of the sample point numbered n is abs(DH(n)). The moving average value of the residual signals after the local decoding of the core layer of sample points numbered less than n is [abs(DH(0))+abs(DH(1))+ . . . +abs(DH(n−1))]÷n. In practice, to simplify the calculation, the division operation may be converted into a multiplication operation. For example, "threshold_avg" may be used to indicate abs(DH(0))+abs(DH(1))+ . . . +abs(DH(n−1)). In this way, the determination in step 2037 is to determine whether the product of abs(DH(n)) and n is larger than "threshold_avg".

Step 2038: Select the sample point numbered n as an enhancement sample point.

Step 2039: Determine whether the number of selected enhancement sample points is equal to EN; if the number of selected enhancement sample points is equal to EN, the process ends; if the number of selected enhancement sample points is not equal to EN, the process proceeds to step 203A.

Step 203A: Determine whether the sum of the remaining sample points and selected enhancement sample points is equal to EN; if the sum of the remaining sample points and selected enhancement sample points is equal to EN, the process proceeds to step 203B; if the sum of the remaining sample points and selected enhancement sample points is not equal to EN, the process proceeds to step 2036.

The remaining sample points are those not processed in step 2037 yet.

Step 203B: Select all the remaining sample points as enhancement sample points and the process ends.

Step 204: Encode the specified residual symbol of the enhancement sample point to obtain an enhancement layer signal code.

This step may be implemented in the following way: obtain a residual symbol according to the result of subtracting the locally decoded signal of the core layer of the enhancement sample point from the original signal of the enhancement sample point, and encode the residual symbol to obtain the enhancement layer signal code of the enhancement sample point. The original signal may be the input signal of the core layer or the input PCM encoded signal of the core layer. The locally decoded signal of the core layer may be the locally decoded signal of the core layer or the locally decoded PCM signal of the core layer.

Specifically, a residual symbol may be obtained according to the result of subtracting the locally decoded residual signal DH(n) of the core layer from the original residual signal of the enhancement sample point, and then the residual symbol is encoded to obtain the enhancement layer signal code of the enhancement sample point.

In this embodiment, the residual symbol of the selected enhancement sample point is encoded at the enhancement layer. Specifically, the residual symbol encoding method is used. Subtracting DH(n) from EH(n) is equivalent to subtracting the locally decoded wideband signal Sd(n) from the original wideband signal. The residual symbol is obtained according to the subtraction result. Then the residual symbol is encoded. For example, determine whether EH(n) minus DH(n) is larger than or equal to 0; if EH(*n*) minus DH(n) is larger than or equal to 0, obtain a positive residual symbol and write one bit "1" in enhancement layer signal encoding to indicate that the residual symbol is positive; if EH(n) minus DH(n) is smaller than 0, obtain a negative residual symbol and write one bit "0" in enhancement layer signal encoding to indicate that the residual symbol is negative. This residual symbol encoding method is simple and efficient.

Step 205: Output a bit stream, where the bit stream includes the core layer signal code and the enhancement layer signal code.

In this embodiment, a signal encoding method without any feedback mechanism is described in steps 201 to 205. An encoding device with a feedback mechanism may be further applied in this embodiment. Specifically, before step 205, the process may include: performing local decoding for the enhancement layer code of the enhancement sample point; according to the locally decoded enhancement layer signal, modifying the signal Sd(n) after the local decoding of the core layer; and according to the modified core layer signal, determining the predicted values of the wideband signals of the subsequent sample points, thus improving the prediction precision of the subsequent sample points.

In a more preferred embodiment, if B is large enough, the enhancement factor $\alpha$ may be set to 1, and all the sample points of the current frame are selected as enhancement sample points; then adjust $\alpha$ to other values smaller than 1, for example, change $\alpha$ to 0.475 or smaller values. In this way, the remaining number of bits (that is, $B-B\times\alpha$) may be used for further enhancement, which further improves the precision of signal encoding and decoding.

If the core layer is provided with a buffer or prediction mechanism, that is, if the core layer requires the locally decoded values of previous sample points when encoding the current sample point (for example, in this embodiment, the core layer of G.722 needs to use the locally decoded values of previous sample points when predicting the current sample point), the enhancement layer signal code may be used as a buffer value, thus improving the precision of the subsequent encoding of the core layer.

The method in this embodiment adaptively adjusts the enhancement sample points for the core layer according to the number of bits that can be used by the enhancement layer. When sufficient bits are available for the enhancement layer, all the sample points of the current frame may be selected as enhancement sample points. When no sufficient bits are available for the enhancement layer, the specific enhancement sample points required by the current frame of the enhancement layer need to be determined according to EN and the nature of the core layer. Thereby, the core layer quality and the extended layer quality are effectively balanced; the core layer code and the local decoding information are effectively used to obtain the enhancement layer code, and the number of bits consumed by the enhancement layer is reduced; Moreover, in this embodiment, Sd(n) may be modified according to the locally decoded enhancement layer signal, and the predicted values of the wideband signals of the subsequent sample points are further determined, which further improves the prediction precision of the subsequent sample points.

Figure 4:
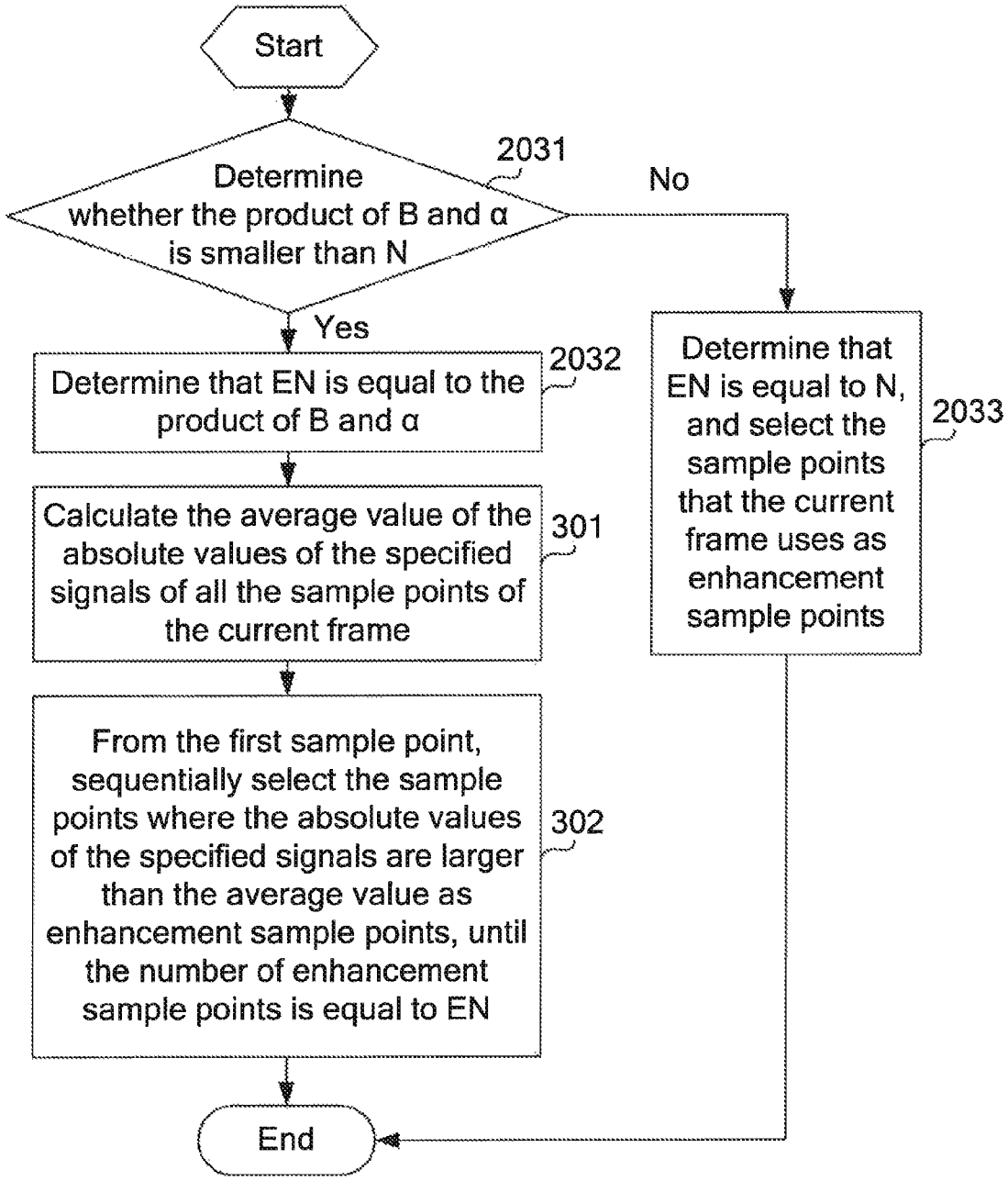
FIG. 4 is a flowchart of step 203 in a signal encoding method according to a third embodiment of the present invention.

FIG. 4 is a flowchart of step 203 in a signal encoding method according to the third embodiment of the present invention. The third embodiment differs from the second embodiment in step 203. In step 203 of this embodiment, after step 2032 is executed, the process includes the following steps:

Step 301: Calculate the average value of the absolute values of the specified signals of all the sample points of the current frame.

Step 302: From the first sample point, sequentially select the sample points where the absolute values of the specified signals are larger than the average value as enhancement sample points, until the number of enhancement sample points is equal to EN.

Figure 5:
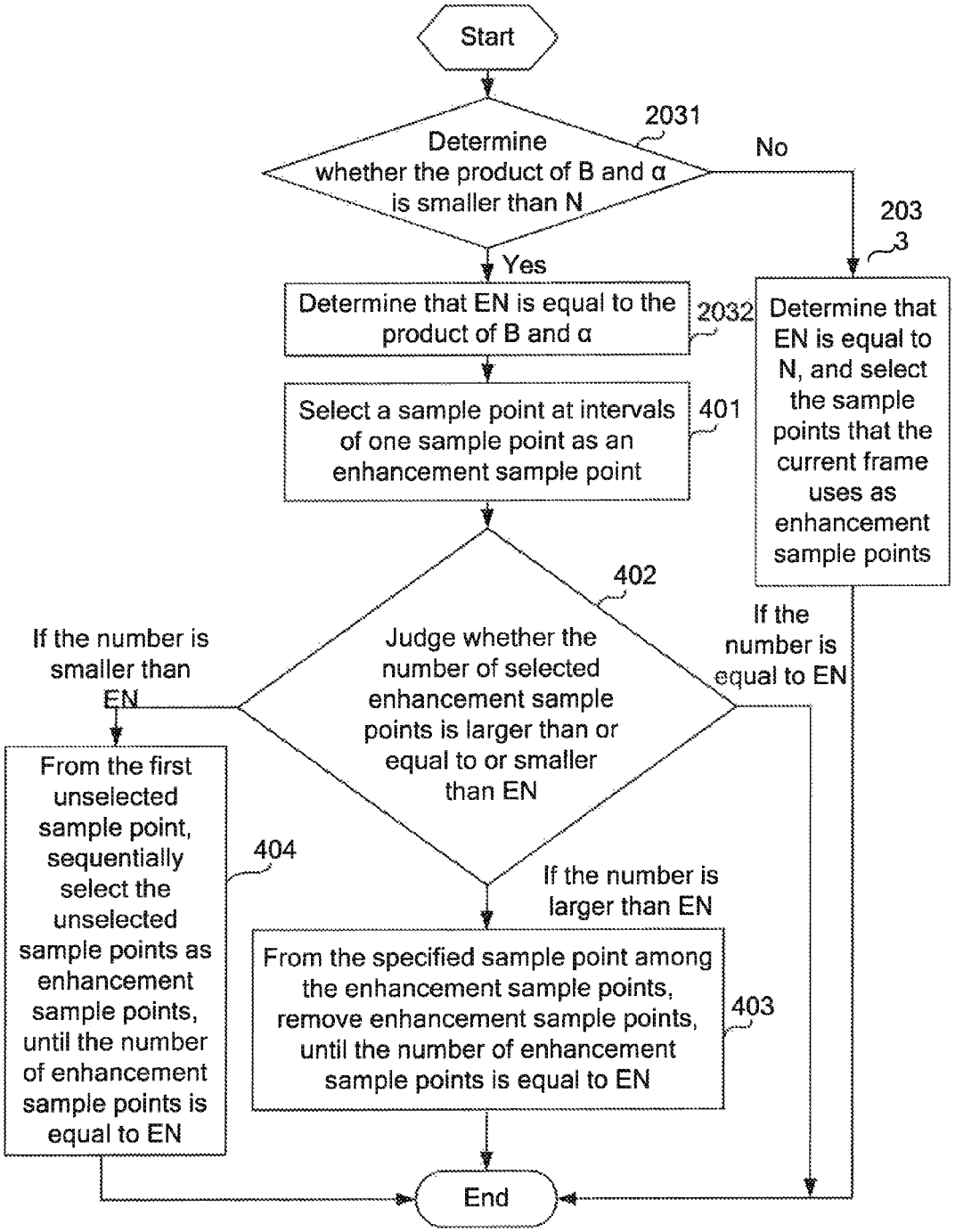
FIG. 5 is a flowchart of step 203 in a signal encoding method according to a fourth embodiment of the present invention.
Figure 6:
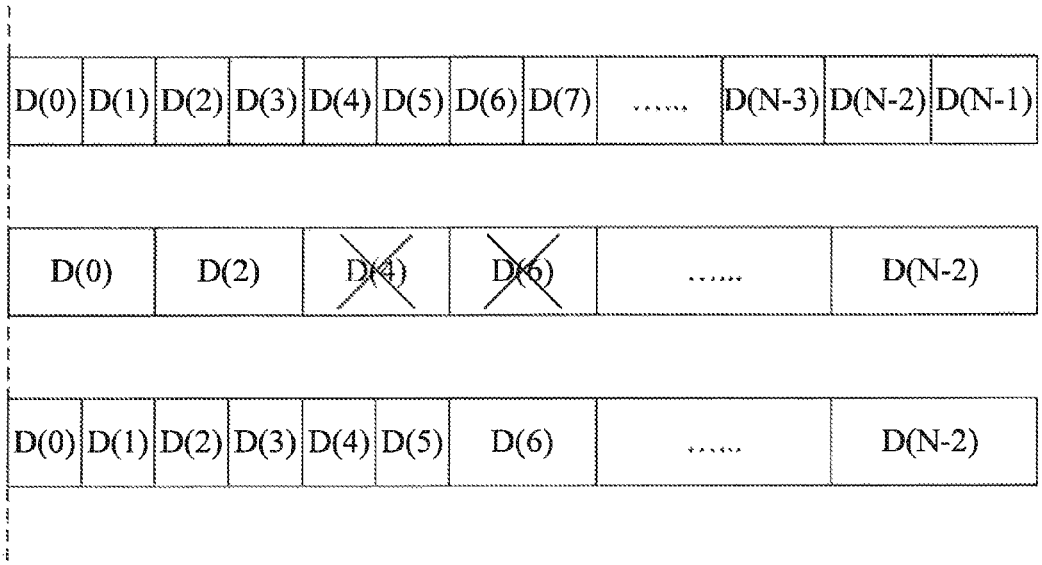
FIG. 6 is a schematic diagram of step 203 in a signal encoding method according to the fourth embodiment of the present invention.

FIG. 5 is a flowchart of step 203 in a signal encoding method according to the fourth embodiment of the present invention. FIG. 6 is a schematic diagram of step 203 in a signal encoding method according to the fourth embodiment of the present invention. The fourth embodiment differs from the second embodiment in step 203. In step 203 of this embodiment, after step 2032 is executed, the process includes the following steps:

Step 401: Select a sample point at intervals of one sample point as an enhancement sample point.

As shown in FIG. 6, among the sample points D(0), D(1), . . . , D(N−2), D(N−1), select a sample point at intervals of one sample point as an enhancement sample point, for example, select D(0), D(2), . . . , D(N−2).

Step 402: Determine the number of selected enhancement sample points; if the number is larger than EN, the process proceeds to step 403; if the number is smaller than EN, the process proceeds to step 404; if the number is equal to EN, the process ends.

Step 403: From the specified sample point among the enhancement sample points, remove enhancement sample points, until the number of enhancement sample points is equal to EN.

As shown in FIG. 6, from the specified sample point D(4), sequentially remove enhancement sample points, for example, D(4) and D(6), until the number of enhancement sample points is equal to EN.

Step 404: From the first unselected sample point, sequentially select the unselected sample points as enhancement sample points, until the number of enhancement sample points is equal to EN.

As shown in FIG. 6, from the first unselected sample point D(1), sequentially select the unselected sample points as enhancement sample points, for example, D(1), D(3), and D(5), until the number of enhancement sample points is equal to EN.

Figure 7:
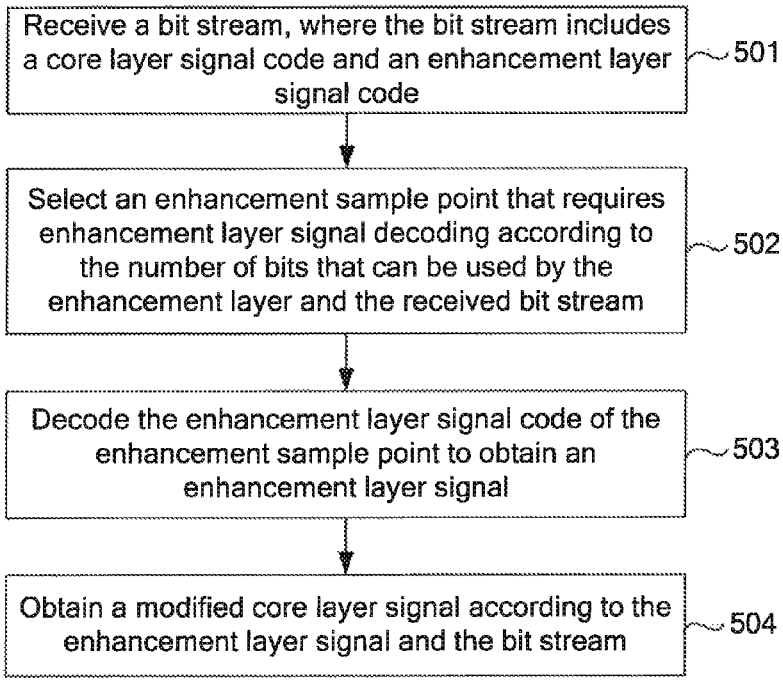
FIG. 7 is a flowchart of a signal decoding method according to the first embodiment of the present invention.

FIG. 7 is a flowchart of a signal decoding method according to the first embodiment of the present invention. The method includes the following steps:

Step 501: Receive a bit stream, where the bit stream includes a core layer signal code and an enhancement layer signal code.

Step 502: Select an enhancement sample point that requires enhancement layer signal decoding according to the number of bits that can be used by the enhancement layer and the received bit stream.

Step 503: Decode the enhancement layer signal code of the enhancement sample point to obtain an enhancement layer signal.

Step 504: Obtain a modified core layer signal according to the enhancement layer signal and the bit stream.

In this embodiment, according to the number of bits that can be used by the enhancement layer, the enhancement sample point that requires enhancement layer signal decoding is selected; the enhancement layer signal of the selected enhancement sample point is decoded; when no sufficient bits are available for the enhancement layer, the enhancement quality of the core layer can be improved.

Figure 8:
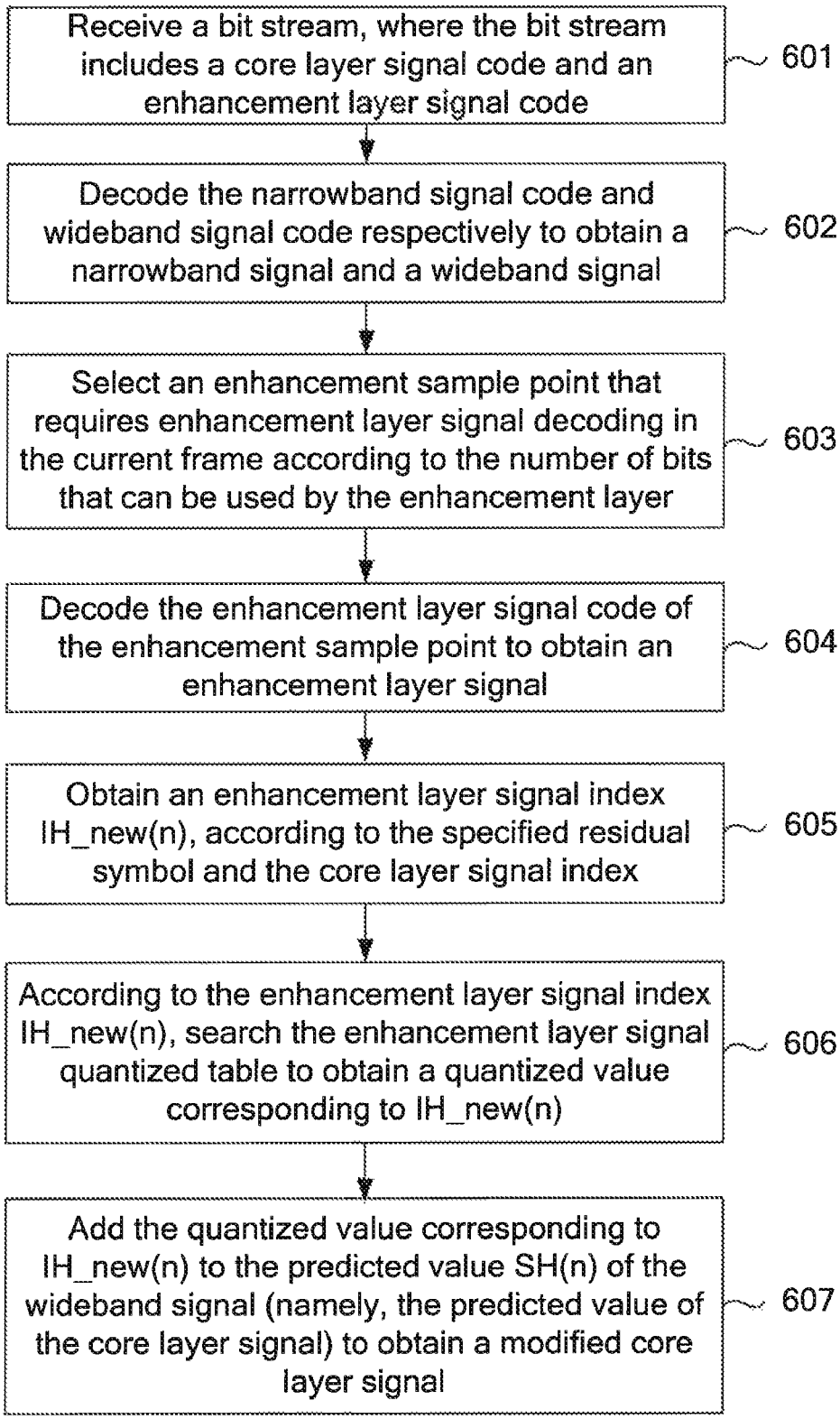
FIG. 8 is a flowchart of a signal decoding method according to the second embodiment of the present invention.

FIG. 8 is a flowchart of a signal decoding method according to the second embodiment. This embodiment may be applied in an extended decoding device that is based on PCM decoding, that is, the core layer signal decoding method may be a PCM decoding method; the core layer may be a G.722 decoder with ADPCM decoding, that is, the core layer signal decoding method may be an ADPCM decoding method. This embodiment may also be applied in other extended decoding devices that are based on PCM or technologies evolved from PCM, for example, an extended decoding device that uses G.711/G.711.1 as the core layer or uses G.722/G.711/G.711.1 with noise shaping or post-processing as the core layer, that is, the core layer signal decoding method may be a PCM/ADPCM decoding method in which the noise shaping technology is used. In addition, this embodiment may be applied in other types of extensions, for example, the wideband extension that uses the narrowband signal decoding as the core layer, the full-band extension, or the stereo extension.

This embodiment is applied in an extended decoding device that uses G.722 as the core layer, where the core layer signal includes a wideband signal and a narrowband signal. The core layer may select an enhancement sample point as per the sample points of a frame, or divide the sample points of each frame into sample points of several sub-frames and select an enhancement sample point as per the sample points of a sub-frame. This embodiment takes a current frame as an example.

The method according to this embodiment includes the following steps.

Step 601: Receive a bit stream, where the bit stream includes a core layer signal code and an enhancement layer signal code, and the core layer signal code includes a wideband signal code and a narrowband signal code.

Step 602: Decode the narrowband signal code and wideband signal code respectively to obtain a narrowband signal and a wideband signal.

For the wideband signal code, in G.722, the ADPCM decoding method is used. The method is as follows: decode the predicted value code of the wideband signal to obtain the predicted value SH(n) of the wideband signal (namely, the predicted value of the core layer signal); perform PCM decoding for the index IH(n) of the wideband signal (namely, the index of the core layer signal) to obtain a predicted residual signal after core layer decoding, where the predicted residual signal is equal to the residual signal DH(n) after the local decoding of the core layer; further, add together the predicted value of the wideband signal and the predicted residual signal after core layer decoding to obtain a wideband signal Sd(n) after core layer decoding, where Sd(n)=SH(n)+DH(n).

The method for decoding a narrowband signal is similar to the method for decoding a wideband signal, and therefore is not described here.

When core layer decoding is performed for the wideband signal and narrowband signal at the same time, the enhancement layer signal may be decoded. The process of selecting an enhancement sample point and decoding an enhancement layer signal is described in steps 603 and 604. This process may be executed after step 602 or during step 602.

Step 603: Select an enhancement sample point that requires enhancement layer signal decoding in the current frame according to the number of bits that can be used by the enhancement layer.

Herein, B indicates the number of bits that can be used by the enhancement layer; $\alpha$ indicates an enhancement factor; N indicates the total number of sample points of the current frame; n indicates the sequence number of a sample point, where $0 \leqq n \leqq N-1$; and EN indicates the number of enhancement sample points of the current frame. In this embodiment, $\alpha$ may be 1.

EN may be determined according to the relation between N and the product of B and $\alpha$. In this embodiment, a value may be directly assigned to EN according to the relation between N and the product of B and $\alpha$, and then EN enhancement sample points are selected. Enhancement sample points may also be selected according to the following embodiment.

In this embodiment, first determine whether the product of B and $\alpha$ is smaller than N; if the product of B and $\alpha$ is smaller than N, determine that EN is equal to the product of B and $\alpha$, and select EN enhancement sample points of the current frame, indicating that no sufficient bits are available for the enhancement layer. Therefore, the specific enhancement sample points required by the current frame of the enhancement layer need to be determined according to EN and the nature of the core layer. If the product of B and $\alpha$ is larger than or equal to N, determine that EN is equal to N, indicating that sufficient bits are available for the enhancement layer, and therefore, select all the sample points of the current frame as enhancement sample points.

EN enhancement sample points of the current frame may be selected according to the following methods.

First method: Obtain the moving average value of the specified signal of the sample point numbered n, where the moving average value is the average value of the absolute values of the specified signals of sample points numbered less than n; and according to the moving average value, determine whether the sample point numbered n is an enhancement sample point that requires enhancement layer signal decoding. Further, the process of determining whether the sample point numbered n is an enhancement sample point that requires enhancement layer signal decoding includes: if $n=0$, selecting the sample point numbered 0 as an enhancement sample point that requires enhancement layer signal decoding; if $n \neq 0$, determining whether the sum of the remaining sample points and selected enhancement sample points is equal to EN; if the sum equal to EN, selecting the remaining sample points as enhancement sample points that require enhancement layer signal decoding and ending the process; if the sum is not equal to EN, determining whether the absolute value of the specified signal of the sample point numbered n is larger than the moving average value, and if the absolute value of the specified signal of the sample point numbered n is larger than the moving average value, selecting the sample point numbered n as an enhancement sample point that requires enhancement layer signal decoding and continuing the process until the number of enhancement sample points is equal to EN; if the absolute value of the specified signal of the sample point numbered n is smaller than or equal to the moving average value, not selecting the sample point numbered n as an enhancement sample point that requires enhancement layer signal decoding. The specified signal may be the predicted residual signal after core layer decoding, or the signal after core layer decoding (for example, the wideband signal after core layer decoding), or the signal after core layer decoding and noise shaping, or the residual signal after core layer decoding and noise shaping. Specifically, this method may be the same as the method for selecting enhancement sample points in the second embodiment of the signal encoding method.

Second method: Calculate the average value of the absolute values of the specified signals of all the sample points of the current frame; and from the first sample point, sequentially select the sample points where the absolute values of the specified signals are larger than the average value as enhancement sample points, until the number of enhancement sample points is equal to EN. The specified signal may be the predicted residual signal after core layer decoding, or the signal after core layer decoding (for example, the wideband signal after core layer decoding), or the signal after core layer decoding and noise shaping, or the residual signal after core layer decoding and noise shaping. Specifically, this method may be the same as the method for selecting enhancement sample points in the third embodiment of the signal decoding method.

Third method: Select a sample point at intervals of one sample point as an enhancement sample point; when the number of enhancement sample points is larger than EN, from the specified sample point among the enhancement sample points, sequentially remove enhancement sample points, until the number of enhancement sample points is equal to EN; and when the number of enhancement sample points is smaller than EN, from the first unselected sample point, sequentially select the unselected sample points as enhancement sample points, until the number of enhancement sample points is equal to EN. Specifically, this method may be the same as the method for selecting enhancement sample points in the fourth embodiment of the signal decoding method.

Step 604: Decode the enhancement layer signal code of the enhancement sample point to obtain an enhancement layer signal.

In this embodiment, the enhancement layer signal is a specified residual symbol. For example, if the enhancement layer signal code is one bit "1", it indicates that the specified residual symbol is positive; if the enhancement layer signal code is one bit "0", it indicates that the specified residual symbol is negative.

Step 605: Obtain an enhancement layer signal index IH_new(n), according to the specified residual symbol and the core layer signal index.

In this embodiment, the core layer signal index is specifically a wideband signal index IH(n), and the wideband signal index IH(n) is an index corresponding to a wideband signal quantized table. In this embodiment, a more fractionalized enhancement layer signal quantized table is used, and the wideband signal index IH(n) is modified into an enhancement layer signal index IH_new(n). Specifically, a preset algorithm may be used to modify the wideband signal index IH(n).

For example, a simple binary left shifting method may be used. When the specified residual symbol is positive, left shift the binary bits of IH(n) by one bit and set the last bit to "1", namely, IH_new(n)=IH(n)*2+1; when the specified residual symbol is negative, left shift the binary bits of IH(n) by one bit and set the last bit to "0", namely, IH_new(n)=IH(n)*2.

Step 606: According to the enhancement layer signal index IH_new(n), search the enhancement layer signal quantized table to obtain a quantized value corresponding to IH_new(n).

Step 607: Add the quantized value corresponding to IH_new(n) to the predicted value SH(n) of the wideband signal (namely, the predicted value of the core layer signal) to obtain a modified core layer signal.

In this embodiment, a specific enhancement sample point is selected according to the number of bits that can be used by the enhancement layer; the enhancement layer signal of the selected enhancement sample point is decoded; when no sufficient bits are available for the enhancement layer, the enhancement quality of the core layer can be improved. Moreover, in this embodiment, the wideband signal index is modified according to the specified residual symbol, and further, a more precise wideband signal is obtained.

The signal decoding method in the third embodiment of the present invention differs from the method of the second embodiment in obtaining a modified core layer signal. In this embodiment, the method for obtaining a modified core layer signal includes: according to the specified residual symbol, using a preset modification factor to modify the predicted residual signal after core layer decoding; and adding up the modified core layer predicted residual signal and the predicted value of the core layer signal to obtain the modified core layer signal.

For example, if there are four quantized values in a wideband signal quantized table, the wideband signal indexes corresponding to the four quantized values are 0, 1, 2, and 3. To keep consistent with the mapping relations of the indexes of the modified wideband signals, four modification factors need to be preset. The four modification factors are attenu0, attnu1, attenu2, and attenu3. Table 1 compares the specified residual symbol, IH(n), modification factor, and modified predicted residual signal.

TABLE 1

Comparison of the specified residual symbol, IH(n), modification factor, and modified predicted residual

| Specified Residual Symbol | IH(n) | Modfication Factor | Modified Predicted Residual Signal |
|---|---|---|---|
| Positive | 0 | attenu0 | DH(n) × attenu0, rounded off |
| Positive | 1 | attenu1 | DH(n) × attenu1, rounded off |
| Positive | 2 | attenu2 | DH(n) × attenu2, rounded off |
| Positive | 3 | attenu3 | DH(n) × attenu3, rounded off |
| Negative | 0 | attenu2 | DH(n) × attenu2, rounded off |
| Negative | 1 | attenu3 | DH(n) × attenu3, rounded off |
| Negative | 2 | attenu0 | DH(n) × attenu0, rounded off |
| Negative | 3 | attenu1 | DH(n) × attenu1, rounded off |

As shown in Table 1, when the specified residual symbol is positive, for a sample point whose wideband signal index IH(n) is 0, the modification factor attenu0 is used to modify the decoded predicted residual signal DH(n), and the modified result is the result of rounding off DH(n)×attenu0.

In this embodiment, the foregoing four modification factors may be set to different values or the same value, or any two of the modification factors are set to the same value. The rounding method may be the foregoing round-off method or direct rounding.

Figure 9:
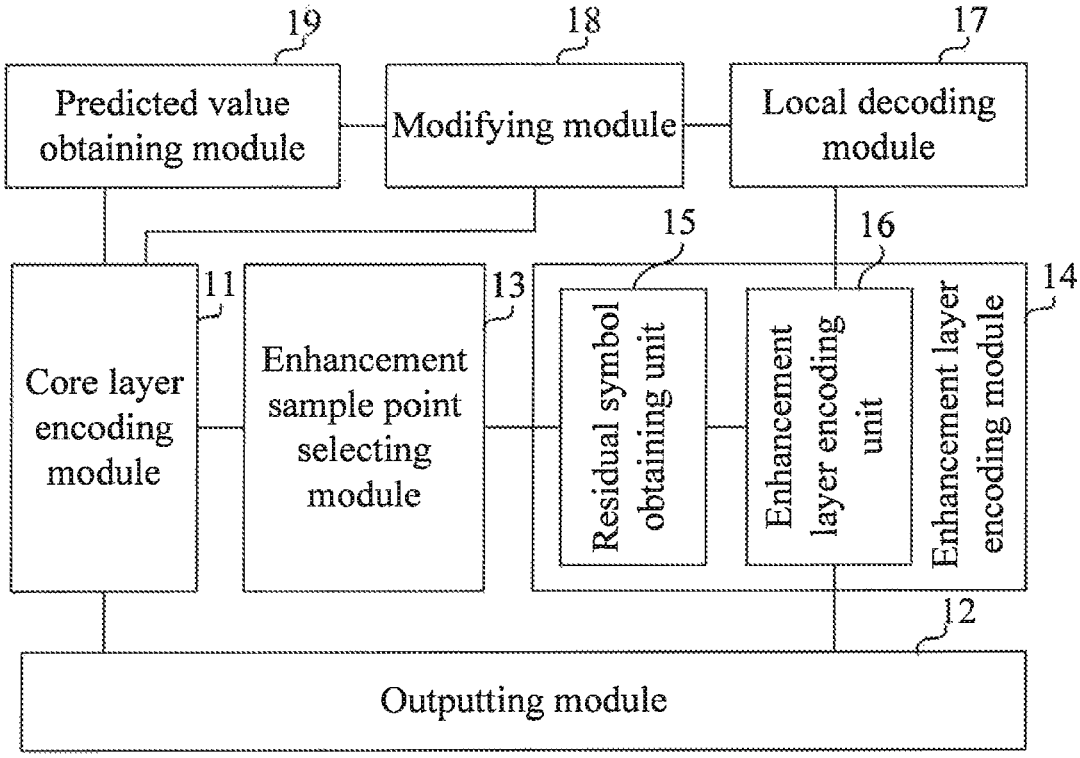
FIG. 9 is a schematic diagram showing a structure of a signal encoding device according to an embodiment of the present invention.

FIG. 9 is a schematic diagram showing the structure of a signal encoding device according to an embodiment of the present invention. The signal encoding device specifically includes a core layer encoding module 11, at least one enhancement layer encoding module, and an outputting module 12. FIG. 9 illustrates only an enhancement sample point selecting module 13 and an enhancement layer encoding module 14 as examples. The core layer encoding module 11 is configured to encode a core layer signal to obtain a core layer signal code. The enhancement sample point selecting module 13 is configured to select, according to the number of bits that can be used by the enhancement layer and the core layer signal code, an enhancement sample point that requires enhancement layer signal encoding. The enhancement layer encoding module 14 is configured to obtain an enhancement layer signal code of the enhancement sample point. The outputting module 12 is configured to output a bit stream, where the bit stream includes the core layer signal code and the enhancement layer signal code.

When the signal encoding device in this embodiment includes multiple enhancement layer encoding modules, a scalable layered structure may be designed, and there may be multiple extended layers, each including an enhancement layer encoding module, and each extended layer may be allocated a certain number of bits to enhance the quality of the core layer, thus implementing embedded encoding. At least one of the multiple extended layers includes an enhancement sample point selecting module, or all or a part of the extended modules include an enhancement sample point selecting module. The following assumes that two enhancement layer encoding modules (first enhancement layer encoding module and second enhancement layer encoding module) are included.

The first enhancement layer encoding module and second enhancement layer encoding module are respectively allocated with A bits and B bits; according to the number of bits A, the enhancement sample point selecting module selects a pieces of enhancement sample points that require enhancement layer signal encoding by the first enhancement layer encoding module, and according to the number of bits B, selects b pieces of enhancement sample points that require enhancement layer signal encoding by the second enhancement layer encoding module; the first enhancement layer encoding module uses the number of bits A to encode the enhancement layer signals of a pieces of enhancement sample points, and the second enhancement layer encoding module uses the number of bits B to encode the enhancement layer signals of b pieces of enhancement sample points; the outputting module outputs a bit stream, where the bit stream includes the core layer signal codes, the enhancement layer signal codes output by the first enhancement layer encoding module, and the enhancement layer signal codes output by the second enhancement layer encoding module. The first enhancement layer encoding module and second enhancement layer encoding module may use the same enhancement layer encoding method or use different enhancement layer encoding methods.

The foregoing enhancement layer encoding module 14 may be specifically configured to encode the specified residual symbol of the enhancement sample point to obtain the enhancement layer signal code. Further, if the residual symbol encoding method is used, the enhancement layer encoding module 14 in this embodiment may include a residual symbol obtaining unit 15 and an enhancement layer encoding unit 16. The residual symbol obtaining unit 15 is configured to obtain a residual symbol according to the result of subtracting the locally decoded signal of the core layer of the enhancement sample point from the original signal of the enhancement sample point; the enhancement layer encoding unit 16 is configured to encode the residual symbol to obtain the enhancement layer signal code of the enhancement sample point.

If a feedback mechanism is used in this embodiment, the signal encoding device may further include a local decoding module 17, a modifying module 18, and a predicted value obtaining module 19. The local decoding module 17 is configured to perform local decoding for the enhancement layer signal code of the enhancement sample point. The modifying module 18 is configured to modify the signal after the local decoding of the core layer according to the locally decoded enhancement layer signal. The predicted value obtaining module 19 is configured to determine the predicted values of the core layer signals of the subsequent sample points according to the modified core layer signal.

In this embodiment, according to the number of bits that can be used by the enhancement layer, the enhancement sample point that requires enhancement layer signal encoding is selected; the enhancement layer signal of the selected enhancement sample point is encoded; when no sufficient bits are available for the enhancement layer, the enhancement quality of the core layer can be improved.

Figure 10:
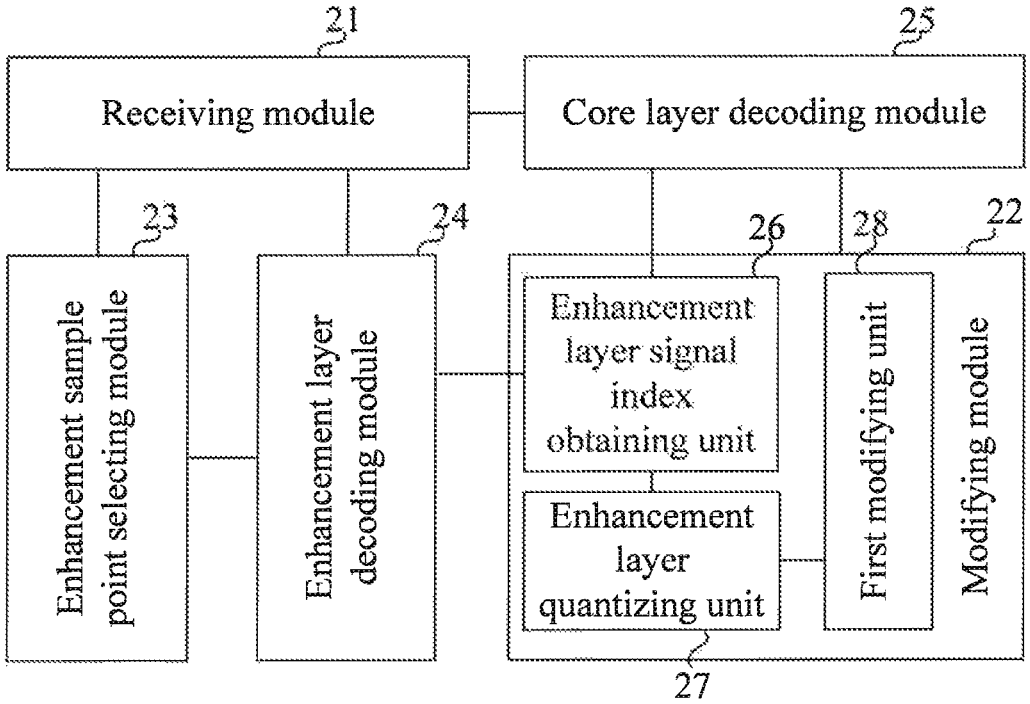
FIG. 10 is a schematic diagram showing a structure of a signal decoding device according to an embodiment of the present invention.

FIG. 10 is a schematic diagram showing the structure of a signal decoding device according to an embodiment of the present invention. The signal decoding device specifically includes a receiving module 21, at least one enhancement sample point selecting module, at least one enhancement layer decoding module, and a modifying module 22. FIG. 10 illustrates only an enhancement sample point selecting module 23 and an enhancement layer decoding module 24 as examples. The receiving module 21 is configured to receive a bit stream, where the bit stream includes a core layer signal code and an enhancement layer signal code. The enhancement sample point selecting module 23 is configured to select, according to the received bit stream and the number of bits that can be used by the enhancement layer, an enhancement sample point that requires enhancement layer signal decoding. The enhancement layer decoding module 24 is configured to decode the enhancement layer signal code of the enhancement sample point to obtain an enhancement layer signal. The modifying module 22 is configured to obtain a modified core layer signal according to the enhancement layer signal and the bit stream.

The signal decoding device in this embodiment may further include a core layer decoding module 25, which is configured to decode the core layer signal code to obtain the predicted value of the core layer signal, the core layer signal index, the predicted residual signal after core layer decoding, and the signal after core layer decoding.

When the signal decoding device in this embodiment includes multiple enhancement layer decoding modules, a scalable layered structure may be designed, and there may be multiple extended layers, each including an enhancement layer decoding module, and each extended layer may be allocated a certain number of bits to enhance the quality of the wideband core layer, thus implementing embedded decoding. At least one of the multiple extended layers includes an enhancement sample point selecting module, or all or a part of the extended modules include an enhancement sample point selecting module. The following assumes that two enhancement layer decoding modules (first enhancement layer decoding module and second enhancement layer decoding module) are included.

The first enhancement layer decoding module and second enhancement layer decoding module are respectively allocated with A bits and B bits; according to the number of bits A, the enhancement sample point selecting module selects a pieces of enhancement sample points that require enhancement layer signal decoding by the first enhancement layer decoding module, and according to the number of bits B, selects b pieces of enhancement sample points that require enhancement layer signal decoding by the second enhancement layer decoding module; the first enhancement layer decoding module uses the number of bits A to decode the enhancement layer signals of a pieces of enhancement sample points, and the second enhancement layer decoding module uses the number of bits B to decode the enhancement layer signals of b pieces of enhancement sample points; the modifying module obtains the modified core layer signals according to the enhancement layer signals output by the first enhancement layer decoding module, and the enhancement layer signals output by the second enhancement layer decoding module. The first enhancement layer decoding module and second enhancement layer decoding module may use the same enhancement layer decoding method or use different enhancement layer decoding methods.

Further, if the enhancement layer signal is a specified residual symbol, the modifying module 22 may include an enhancement layer signal index obtaining unit 26, an enhancement layer quantizing unit 27, and a first modifying unit 28. The enhancement layer signal index obtaining unit 26 is configured to obtain an enhancement layer signal index according to the specified residual symbol and the core layer signal index. The enhancement layer quantizing unit 27 is configured to find a corresponding quantized value according to the enhancement layer signal index. The first modifying unit 28 is configured to add the quantized value corresponding to the enhancement layer signal index to the predicted value of the core layer signal to obtain the modified core layer signal. The modifying module 22 may further include a second modifying unit and a core layer signal obtaining unit. According to the specified residual symbol, the second modifying unit uses a preset modification factor to modify the predicted residual signal after core layer decoding. The core layer signal obtaining unit adds up the modified core layer predicted residual signal and the predicted value of the core layer signal to obtain the modified core layer signal.

In this embodiment, according to the number of bits that can be used by the enhancement layer, the enhancement sample point that requires enhancement layer signal decoding is selected; the enhancement layer signal of the selected enhancement sample point is decoded; when no sufficient bits are available for the enhancement layer, the enhancement quality of the core layer can be improved.

Figure 11:
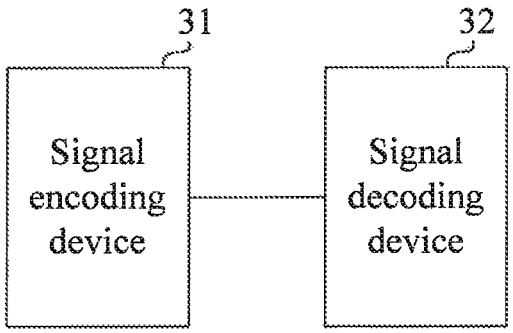
FIG. 11 is a schematic diagram showing a structure of a signal encoding and decoding system according to an embodiment of the present invention.

FIG. 11 is a schematic diagram showing the structure of a signal encoding and decoding system according to an embodiment of the present invention. The signal encoding and decoding system specifically includes a signal encoding device 31 and a signal decoding device 32.

The signal encoding device 31 is configured to: encode a core layer signal to obtain a core layer signal code; select, according to the core layer signal code and the number of bits that can be used by the enhancement layer, an enhancement sample point that requires enhancement layer signal encoding; obtain an enhancement layer signal code of the enhancement sample point; and output a bit stream, where the bit stream includes the core layer signal code and the enhancement layer signal code.

The signal decoding device 32 is configured to: receive the bit stream, where the bit stream includes the core layer signal code and the enhancement layer signal code; select an enhancement sample point that requires enhancement layer signal decoding according to the number of bits that can be used by the enhancement layer and the received bit stream; decode the enhancement layer signal code of the enhancement sample point to obtain an enhancement layer signal; and obtain a modified core layer signal according to the enhancement layer signal and the bit stream.

The signal encoding device 31 may encode the signal according to any embodiment of the present invention. The signal decoding device 32 may decode the signal according to any embodiment of the present invention.

Those skilled in the art may understand that all or a part of the steps of the method according to the embodiments of the present invention may be implemented by a program instructing relevant hardware. The program may be stored in a computer readable storage medium. When the program runs, the steps of the method according to the embodiments of the present invention are performed. The storage medium may be a read only memory (ROM), a random access memory (RAM), a magnetic disk, or a compact disk-read only memory (CD-ROM).

It should be noted that the above embodiments are merely provided for describing the technical solution of the present invention, but not intended to limit the present invention. Although the present invention has been described in detail with reference to the foregoing embodiments, those skilled in the art may make various modifications and variations to the invention without departing from the spirit and scope of the invention. The invention shall cover the modifications and variations provided that they fall in the scope of protection defined by the following claims or their equivalents.

What is claimed:

1. A signal encoding method, comprising:

encoding a core layer signal to obtain a core layer signal code;

selecting an enhancement sample point from a plurality of sample points, wherein the enhanced sample point that requires enhancement layer signal encoding according to the core layer signal code and a number of bits that can be used by an enhancement layer, wherein N indicates a total number of the sample points, wherein n indicates a sequence number for each sample point, wherein $0 \leqq n \leqq N-1$, and wherein selecting the enhancement sample point further comprises:

obtaining a moving average value of a specified signal of a sample point numbered n, wherein the moving average value is an average value of absolute values of specified signals of sample points numbered less than n; and determining whether the sample point numbered n is the enhancement sample point according to the moving average value;

obtaining an enhancement layer signal code of the enhancement sample point; and outputting a bit stream that comprises the core layer signal code and the enhancement layer signal code.

2. The signal encoding method according to claim 1, wherein EN indicates the number of enhancement sample points, wherein EN equals 19, wherein N equals 40, and wherein determining whether the sample point numbered n is the enhancement sample point comprises:

if n is equal to 0, selecting the sample point numbered 0 as the enhancement sample point; and if n is not equal to 0, determining whether the sum of the remaining sample points and the selected enhancement sample point is equal to EN, wherein if the sum is equal to EN, then the remaining sample points are selected as enhancement sample points that require enhancement layer signal encoding.

3. The signal encoding method according to claim 2, wherein if n is equal to 0 and the sum is not equal to EN, then determining whether the sample point numbered n is the enhancement sample point further comprises:

determining whether the absolute value of the specified signal of the sample point numbered n is larger than the moving average value; and if the absolute value of the specified signal of the sample point numbered n is larger than the moving average value, selecting the sample point numbered n as the enhancement sample point and continuing the process until the number of enhancement sample points is equal to EN.

4. The signal encoding method according to claim 1, wherein the specified signal comprises a signal or a residual signal after local decoding of a core layer or after local decoding of the core layer and noise shaping.

5. The signal encoding method according to claim 1, wherein obtaining the enhancement layer signal code comprises:

obtaining a residual symbol according to a result of subtracting a locally decoded signal of a core layer of the enhancement sample point from an original signal of the enhancement sample point, wherein the original signal is an input signal of the core layer or an input pulse code modulation (PCM) encoded signal of the core layer, and the locally decoded signal is the locally decoded signal of the core layer or the locally decoded PCM signal of the core layer; and encoding the residual symbol to obtain the enhancement layer signal code of the enhancement sample point.

6. A signal encoding device comprising:

a hardware, the hardware comprising:

a core layer encoding module, configured to encode a core layer signal to obtain a core layer signal code;

at least one enhancement sample point selecting module, configured to select an enhancement sample point from a plurality of sample points, wherein the enhanced sample point that requires enhancement layer signal encoding according to the core layer signal code and a number of bits that can be used by an enhancement layer, wherein N indicates a total number of the sample points, wherein n indicates a sequence number for each sample point, wherein $0 \leqq n \leqq N-1$, and wherein selecting the enhancement sample point further comprises:

obtaining a moving average value of a specified signal of a sample point numbered n, wherein the moving average value is an average value of absolute values of specified signals of sample points numbered less than n; and determining whether the sample point numbered n is the enhancement sample point according to the moving average value;

at least one enhancement layer encoding module, configured to obtain an enhancement layer signal code of the enhancement sample point; and an outputting module, configured to output a bit stream, wherein the bit stream comprises the core layer signal code and the enhancement layer signal code.

7. The signal encoding device according to claim 6, wherein EN indicates the number of enhancement sample points, wherein EN equals 19, wherein N equals 40, and wherein the second module is further configured to;

if n is equal to 0, select the sample point numbered 0 as the enhancement sample point; and if n is not equal to 0, determine whether the sum of the remaining sample points and the selected enhancement sample point is equal to EN, wherein if the sum is equal to EN, then the remaining sample points are selected as enhancement sample points that require enhancement layer signal encoding.

8. The signal encoding device according to claim 7, wherein the second module is further configured to:

if the sum is not equal to EN, determine whether the absolute value of the specified signal of the sample point numbered n is larger than the moving average value; and if the absolute value of the specified signal of the sample point numbered n is larger than the moving average value, select the sample point numbered n as the enhancement sample point and continue the process until the number of enhancement sample points is equal to EN.

9. The signal encoding device according to claim 6, wherein the enhancement layer encoding module comprises:

a residual symbol obtaining unit, configured to obtain a residual symbol according to a result of subtracting a locally decoded signal of a core layer of the enhancement sample point from an original signal of the enhancement sample point; and an enhancement layer encoding unit, configured to encode the residual symbol to obtain the enhancement layer signal code of the enhancement sample point.

10. A non-transitory computer readable storage medium comprising:

a computer program for signal encoding that when executed is operable to:

encode a core layer signal to obtain a core layer signal code;

select an enhancement sample from a plurality of sample points, wherein the enhanced sample point that requires enhancement layer signal encoding according to the core layer signal code and the number of bits that can be used by an enhancement layer, wherein N indicates a total number of the sample points, wherein n indicates a sequence number for each sample point, wherein $0 \leqq n \leqq N-1$, and wherein selecting the enhancement sample point further comprises:

obtaining a moving average value of a specified signal of a sample point numbered n, wherein the moving average value is an average value of absolute values of specified signals of sample points numbered less than n; and determining whether the sample point numbered n is the enhancement sample point according to the moving average value;

obtain an enhancement layer signal code of the enhancement sample point; and output a bit stream that comprises the core layer signal code and the enhancement layer signal code.

* * * * *